US009404071B2

(12) United States Patent
Labeque et al.

(10) Patent No.: US 9,404,071 B2
(45) Date of Patent: Aug. 2, 2016

(54) USE OF COMPOSITION TO REDUCE WEEPING AND MIGRATION THROUGH A WATER SOLUBLE FILM

(71) Applicant: The Procter & Gamble Company, Cincinnati, OH (US)

(72) Inventors: Regine Labeque, Neder over Heembeek (BE); Katrien Andrea Lieven Van Elsen, Puurs (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/731,455

(22) Filed: Jun. 5, 2015

(65) Prior Publication Data

US 2015/0267154 A1 Sep. 24, 2015

Related U.S. Application Data

(63) Continuation of application No. PCT/US2013/073259, filed on Dec. 5, 2013.

(30) Foreign Application Priority Data

Dec. 6, 2012 (EP) ..... 12195792

(51) Int. Cl.

| | |
|---|---|
| ***C11D 1/02*** | (2006.01) |
| ***C11D 3/40*** | (2006.01) |
| ***C11D 17/04*** | (2006.01) |
| ***C11D 3/43*** | (2006.01) |

(52) U.S. Cl.

CPC ..... *C11D 17/042* (2013.01); *C11D 1/02* (2013.01); *C11D 3/43* (2013.01)

(58) Field of Classification Search

CPC ..... C11D 1/02; C11D 3/2006; C11D 3/2044; C11D 3/2065; C11D 3/40; C11D 17/042

See application file for complete search history.

(56) References Cited

U.S. PATENT DOCUMENTS

| | | | | |
|---|---|---|---|---|
| 2002/0077264 | A1 | 6/2002 | Roberts et al. | |
| 2004/0063601 | A1 | 4/2004 | Denome et al. | |
| 2005/0244444 | A1 | 11/2005 | Kochvar et al. | |
| 2006/0079438 | A1 | 4/2006 | Brush et al. | |
| 2006/0217288 | A1 | 9/2006 | Wahl et al. | |
| 2007/0105739 | A1 | 5/2007 | Wahl et al. | |
| 2008/0234169 | A1 | 9/2008 | Boutique et al. | |
| 2009/0312220 | A1 | 12/2009 | Boutoille et al. | |
| 2009/0320212 | A1* | 12/2009 | Brown | C11D 1/65 8/137 |
| 2011/0189413 | A1 | 8/2011 | Denome et al. | |
| 2011/0278194 | A1 | 11/2011 | Zhu | |
| 2011/0303576 | A1 | 12/2011 | Ricci et al. | |
| 2012/0175797 | A1* | 7/2012 | Labeque | C11D 17/043 264/4 |
| 2012/0304402 | A1 | 12/2012 | Miracle et al. | |
| 2013/0245242 | A1* | 9/2013 | Torres | C09B 29/0802 534/794 |
| 2014/0162929 | A1 | 6/2014 | Labeque | |

FOREIGN PATENT DOCUMENTS

EP 2 476 744 A1 7/2012

OTHER PUBLICATIONS

PCT Search Report PCT/US2013/073259; Dated Mar. 21, 2014; 9 Pages.

PCT Search Report PCT/US2013/073475; dtd Apr. 9, 2014; 10 Pages.

* cited by examiner

*Primary Examiner* — Brian P Mruk

(74) *Attorney, Agent, or Firm* — Gregory S Darley-Emerson; Leonard W Lewis; Steve W Miller

(57) ABSTRACT

The present invention relates to the use of a composition comprising a) anionic surfactant; and b) solvent system comprising at least one primary solvent having Hansen solubility (δ) of less than 29 said composition being encapsulated in a water soluble film pouch, for reducing migration and weeping of said composition through said film.

20 Claims, No Drawings

USE OF COMPOSITION TO REDUCE WEEPING AND MIGRATION THROUGH A WATER SOLUBLE FILM

TECHNICAL FIELD

The present invention relates to the use of a composition comprising anionic surfactant and solvent, when encapsulated within a water-soluble film, for reducing migration and weeping of the composition through the film.

BACKGROUND OF THE INVENTION

Water-soluble unitized dose products have become popular in recent years. The compositions held within the water-soluble film must have a controlled amount of water so as not to preemptively dissolve the film. Instead of water, unitized dose compositions comprise solvents to solubilise ingredients and act as a carrier. In addition to these effects, solvents in the composition within the product or within the film, plasticise the film, making it more elastic and supple. However depending on the choice of solvent or amount thereof, the Applicants have found that the solvent can also negatively affect the film structure and integrity. The Applicants have found that solvents can affect whether or not, or the speed of which components of the composition migrate or weep through the film. This is particularly a problem where the weeping is excessive and the pouch takes on a slimy, unpleasant feeling. Moreover if weeping is too great, the external surface of the pouch becomes moist, and premature dissolution of points in the film results in adjacent pouches sticking to one another. Furthermore, if the pouch is a multi-compartment pouch comprising different, potentially incompatible, compositions in each compartment, then migration of the composition from one compartment to another can have other undesirable consequences. For example, a migrating component of the composition may deactivate andenzyme or perfume, or a dye may colour the other composition, or cause an unwanted reaction. Hence the object of the present invention has been to reduce the above problems, by reducing and controlling the level of weeping and migration of a composition or components of the composition through the film.

SUMMARY OF THE INVENTION

According to the present invention there is provided the use of a composition comprising a) anionic surfactant; and b) solvent system comprising at least one primary solvent having Hansen solubility (δ) of less than 29, said composition being encapsulated in a water soluble film pouch, for reducing migration and weeping of said composition through said film.

DETAILED DESCRIPTION OF THE INVENTION

The present application relates to the use of a composition for controlling migration and weeping of a composition through a water soluble film. By the term weeping it is meant the travel of a composition, or components of the composition, encapsulated within a water-soluble film pouch, from within a pouch to outside the pouch. By the term migration it is meant weeping from one compartment of a multi-compartment pouch, to another compartment of the same pouch.

Plasticization is a term used to describe the elasticity, flexibility and brittleness of film. A film that is completely elastic, will recover its original shape once having been stretched. A film that is overplasticized tends to gain elasticity, eventually losing rigidity and becoming floppy.

Eventually, if plasticization continues, the film can become so weak, that it fails, rips and/or developing holes. By contrast if a plasticizer is not used, is lost or too little is used then the film becomes increasingly brittle over time, which again results in failure. Plasticizing solvents can be incorporated into the film on production, indeed this is most often the case, for ease of processing. However in addition plasticizing solvent can also be present in the composition which the film encapsulates. It is the Applicants belief that incorporating the specific plasticizing solvents of the present invention provides a beneficial plasticization of the film, that encourages the reduction of migration and weeping.

Detergent Composition

The detergent composition comprises an anionic surfactant and a solvent system. The solvent system comprises at least one primary solvent having Hansen solubility (δ) of less than 29.

Anionic Surfactant

The composition of the present invention comprises an anionic surfactant. Preferably the composition comprises from 1% to 80% by weight of an anionic surfactant. More preferably the composition comprises from 2 to 60%, more preferably from 7 to 50% and most preferably 10 to 40% anionic surfactant by weight of the composition.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially preferred are linear straight chain alkylbenzene sulfonates in which the average number of carbon atoms in the alkyl group is from about 11 to 13, abbreviated as $C_{11}$-$C_{13}$ LAS, sodium, potassium and ammonium alkyl polyethoxylate sulfates having from 12 to 18 carbon atoms and mixtures thereof.

Solvent System

The composition of the present invention comprises a solvent system. The solvent system comprises at least one primary solvent having Hansen solubility (δ) of less than 29, more preferably less than 28.5 and preferably greater than 10, more preferably greater than 15.

The Hansen solubility parameter is a well known and calculated parameter based on a three component measuring system. The Hansen solubility parameter is based on a dispersion force component ($\delta_d$), a hydrogen bonding component ($\delta_h$) and a polar component ($\delta_p$). The Hansen solubility parameter (δ) is derived from the fact that the total cohesive energy, which is the energy required to break all the cohesive bonds, is the combination of the dispersion forces (d), the molecular dipole forces (p) and the hydrogen bonding forces (h) according to the following equation:

$\delta^2=\delta_d^2+\delta_p^2+\delta_h^2$ δ is achieved by finding the square root of $\delta^2$ Dispersion forces are weak attractive forces between non-polar molecules. The magnitude of these forces depends on the polarizability of the molecule, and the dispersion hansen solubility parameter ($\delta_d$) typically increases with increasing volume (and size) of the molecule, all other properties being roughly equal. Hansen solubility parameters are calculated at 25° C., with ChemSW's molecular modeling Pro v6.1.9 software package which uses an unpublished proprietary algorithm that is based on values published in the Handbook of solubility Parameters and other parameters by Allan F M Barton (CRC Press 1983) for solvents obtained experimentally by Hansen.

The primary solvent preferably has molecular weight of less than 1500, more preferably less than 1000, even more preferably less than 700. The primary solvent preferably has a molecular weight of greater than 10, more preferably greater than 100. The primary solvent preferably has a c Log P of greater than −1.0 and more preferably less than +10. The primary solvent preferably has a Hydrogen bonding component ($\delta_h$) of less than 20.5, and preferably greater than 10.

The primary solvent is preferably selected from the group consisting of polyethylene glycol (PEG) polymer having molecular weight between 300 and 600, dipropylene glycol (DPG), nbutoxy propoxy propanol (nBPP) and mixtures thereof. More preferably the primary solvent is selected from the group consisting of polyethylene glycol (PEG) polymer having molecular weight between 400 and 600, dipropylene glycol (DPG), nbutoxy propoxy propanol (nBPP) and mixtures thereof. Table 1 shows the Hansen Solubility components of the preferred primary solvents and some comparative solvents falling outside of the scope of the invention.

TABLE 1

| Hansen solubility component parameters | | | | | |
|---|---|---|---|---|---|
| Solvent | δ Dispersion | δ Polarity | δ H-bonding | δ | cLog P |
| PEG 200 | 16.54 | 11.22 | 20.91 | 28.9 | −1.47 |
| PEG 300 | 16.23 | 10.09 | 20.17 | 27.8 | −1.22 |
| PEG 400 | 15.81 | 8.21 | 19.12 | 26.1 | −0.7 |
| PEG 600 | 18.98 | 11.22 | 20.91 | 28.9 | −0.74 |
| DPG | 16.67 | 10.86 | 20.35 | 28.5 | −0.6 |
| Propane diol | 16.41 | 10.82 | 23.07 | 30.3 | −1.1 |
| Glycerol | 17.29 | 12.22 | 27.34 | 34.6 | −1.94 |
| Sorbitol | 19.24 | 11.5 | 23.4 | 32.4 | −2.54 |
| nBPP | 15.99 | 5.42 | 8.91 | 19.1 | +1.99 |

The primary solvent is preferably present at a level of from 1 to 25%, preferably from 2.5 to 20%, more preferably from 4 to 19% by weight of the composition.

In a preferred embodiment, the solvent system also comprises a secondary solvent. The secondary solvent is preferably selected from the group consisting of glycerol, water and mixtures thereof. When the secondary solvent comprises glycerol, glycerol is preferably present at a level of less than 5%, more preferably less than 4%, more preferably less than 3%, most preferably less than 2% by weight of the composition. Preferably the glycerol secondary solvent is present at a level of greater than 0.1%, more preferably greater than 0.5%, most preferably greater than 1% by weight of the composition. The secondary solvent may also comprise water. When water is present it is preferably present at a level of less than 20%, more preferably less than 15%, most preferably less than 10% by weight of the composition.

In a further preferred embodiment the ratio of primary solvent to secondary solvent glycerol is from 7:1 to 1:5, more preferably from 6.5:1 to 1:3, most preferably 3:1 to 1:1.

Negatively Charged Hueing Dye

The compositions of the present invention preferably comprise a negatively charged hueing dye. By the term negatively charged hueing dye it is meant that the dye residue comprises a moiety capable of being negatively charged in the composition. Preferably the composition will comprise from 0.00001 wt % to 0.5 wt % of hueing dye.

Typically the hueing dye provides a blue or violet shade to fabric. Hueing dyes can be used either alone or in combination to create a specific shade of hueing and/or to shade different fabric types. This may be provided for example by mixing a red and green-blue dye to yield a blue or violet shade. Hueing dyes may be selected from any known chemical class of dye chromophore including, but not limited to, acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methine, naphthalimides, naphthoquinone, nitro and nitroso, oxazine, phthalocyanine, pyrazoles, stilbene, styryl, triarylmethane, triphenylmethane, xanthenes, tripehnooxazine and mixtures thereof.

Preferred negatively charged hueing dyes comprise those selected from the group having Formula I below.

$$[D]—[A]_n \qquad \text{Formula I}$$

wherein D represents the residue of a dye comprising a chromophore group, and A is a moiety selected from the group consisting of $OSO_3M$, $SO_3M$, $CO_2M$, $OCO_2M$, $OPO_3M_2$, $OPO_3HM$ and $OPO_2M$. More preferably A is selected from the group consisting of $OSO_3M$, $SO_3M$, $CO_2M$, and $OCO_2M$. Even more preferably A is selected from the group consisting of $SO_3M$ and $CO_2M$. M is any suitable charge balancing counterion. M is preferably selected from the group consisting of Hydrogen, an alkali or alkali earth metal ion. More preferably M is selected from the group consisting of hydrogen, sodium or potassium ion. The index n is preferably an integer from 1 to 6, more preferably from 1 to 4, even more preferably n=1 or 2.

Typically the dye or mixture of dyes of Formula I will be present in the composition in an amount from 0.00001 to 5 wt % of the composition, more usually in an amount from 0.0001 or from 0.001 to 1 wt % or to 0.5 wt % or to 0.25 wt % of the composition.

The dye residue, D, may comprise one or more of any suitable class of chromophore group. Suitable chromophore groups include, but are not limited, to any suitable chromophore, preferably selected from the group listed above. More preferably the chromophore group is selected from the group consisting of benzodifurane, methine, triphenylmethane, azine, tripehnoxazine, naphthalimide, pyrazole, naphthoquinone, anthraquinone, mono-azo and bis-azo and mixtures thereof. More preferably the dye residue, D, is selected form the group consisting of Azine, anthraquinone and azo chromophores may be preferred in some embodiments.

Preferably the hueing dye is a blue or violet hueing dye, providing a blue or violet color to a white cloth or fabric with a hue angle of 240 to 345, more preferably 260 to 325, even more preferably 270 to 310.

In one aspect, a hueing dye suitable for use in the present invention has, in the wavelength range of about 400 nm to about 750 nm, in methanol solution, a maximum extinction coefficient greater than about 1000 liter/mol/cm. In one aspect, a hueing dye suitable for use in the present invention has, in the wavelength range of about 540 nm to about 630 nm, a maximum extinction coefficient from about 10,000 to about 100,000 liter/mol/cm. In one aspect, a hueing dye suitable for use in the present invention has, in the wavelength range of about 560 nm to about 610 nm, a maximum extinction coefficient from about 20,000 to about 70,000 liter/mol/cm.

Preferred hueing dyes are selected from the group consisting of thiophene azo carboxylate dyes having the generalized structure of Formula II:

Formula II

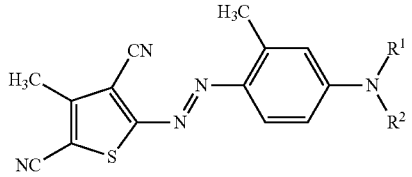

wherein $R^1$ and $R^2$ are independently selected from $[(CH_2CR'HO)_x(CH_2CR''HO)_yQ]$, $C_{1-12}$ alkyl, $C_{6-10}$ aryl, $C_7$-$C_{22}$ aryl alkyl, with the requirement that at least one of $R^1$ or $R^2$ is $[(CH_2CR'HO)_x(CH_2CR''HO)_yQ]$, wherein R' is selected from the group consisting of H, $C_{1-4}$ alkyl, $CH_2O(CH_2CH_2O)_zQ$, phenyl and $—CH_2OR^5$; wherein R" is selected from the group consisting of H, $C_{1-4}$ alkyl, $CH_2O(CH_2CH_2O)_zQ$, phenyl and $CH_2OR^5$; wherein 1 or $2 \leq x+y \leq 50$, preferably $x+y \leq 25$, more preferably $x+y \leq 10$; wherein $y \geq 1$; wherein z=0 or 1 to 20 preferably 0 to 10 or 5; and wherein Q is selected from the group consisting of H and Y wherein Y is as defined below; with the proviso that the dye comprises at least one Q group that is Y;

each $R^5$ is selected from the group consisting of $C_1$-$C_{16}$ linear or branched alkyl, $C_6$-$C_{14}$ aryl and $C_7$-$C_{16}$ arylalkyl; preferably $R^5$ is selected from the group consisting of methyl, ethyl, propyl, isopropyl, butyl, sec-butyl, isobutyl, t-butyl, hexyl, 2-ethylhexyl, octyl, decyl, dodecyl, tetradecyl, hexadecyl, phenyl, benzyl, 2-phenylethyl, naphthyl and mixtures thereof; and wherein Y is an organic radical represented by Formula III Formula III

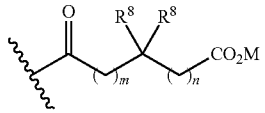

wherein independently for each Y group, M is H or a charge balancing cation; m is 0 to 5, preferably 0, 1, 2 or 3; n is 0 to 5, preferably 0, 1, 2 or 3; the sum of m+n is 1 to 10, preferably 1, 2 or 3; each R8 is independently selected from the group consisting of H and C3-18 or C4-C18 or even C4-7 and/or C9-18 alkenyl, and wherein at least one R8 group is not H. Such dyes are discussed in the Applicants co-pending currently unpublished U.S. patent application Ser. No. 61/598,014

Suitable negatively charged dyes may also be selected from the group consisting of carboxylate dyes having the structure of Formula IV:

$$D—L—CO_2M \qquad \text{Formula IV}$$

wherein D is as defined above and L is an organic linking group preferably having a molecular weight from 14 to 1000 Daltons, or 14 to 600, or 28 to 300, preferably consisting essentially only of C, H and optionally additionally O and/or N, and in the sequence of bonds starting from the carbonyl carbon of the C(O)OM group and ending at the dye moiety, any $—(C_a(O)—O_b)—$ groups are incorporated such that the oxygen atom $O_b$ is encountered prior to the carbonyl carbon $C_a$. Preferably L is a $C_{1-20}$ alkylene chain having optionally therein ether (—O—) and/or ester and/or amide links, the chain being optionally substituted for example with —OH, —CN, $—NO_2$, $—SO_2CH_3$, —Cl, —Br; and M is any suitable counterion, typically hydrogen, sodium or potassium ion. Such dyes are discussed in the applicants co-pending U.S. patent application Ser. No. 61/612,539.

Other dyes suitable for use in the present invention include those described in the applicants co-pending patent application, U.S. Ser. No. 13/478,148 and WO 2012/054058 A1.

Suitable hueing dyes may also include small molecule dyes and polymeric dyes. Suitable small molecule dyes may include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes may include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in US 2008/034511 A1 or U.S. Pat. No. 8,268,016 B2, or dyes as disclosed in U.S. Pat. No. 7,208,459 B2, and mixtures thereof. In another aspect, suitable small molecule dyes may include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes may include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes may include those described in WO2011/98355, US 2012/225803 A1, US 2012/090102 A1, U.S. Pat. No. 7,686,892 B2, and WO2010/142503.

In another aspect, suitable polymeric dyes may include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes may include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Preferred hueing dyes may include the whitening agents found in WO 08/87497 A1, WO2011/011799 and US 2012/129752 A1. Preferred hueing dyes for use in the present invention may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in U.S. Pat. No. 7,909,890 B2.

The aforementioned fabric hueing agents can be used in combination (any mixture of fabric hueing agents can be used).

Test Methods

I. Method for Determining Deposition for a Dye a.) Unbrightened Multifiber Fabric Style 41 swatches (MFF41, 5 cm×10 cm, average weight 1.46 g) serged with unbrightened thread are purchased from Testfabrics, Inc. (West Pittston, Pa.). MFF41 swatches are stripped prior to use by washing two full cycles in AATCC heavy duty liquid laundry detergent (HDL) nil brightener at 49° C. and washing 3 additional full cycles at 49° C. without detergent. Four replicate swatches are placed into each flask.

b.) A sufficient volume of AATCC standard nil brightener HDL detergent solution is prepared by dissolving the detergent in 0 gpg water at room temperature at a concentration of 1.55 g per liter.

c.) A concentrated stock solution of dye is prepared in an appropriate solvent selected from dimethyl sulfoxide (DMSO), ethanol or 50:50 ethanol:water. Ethanol is preferred. The dye stock is added to a beaker containing 400 mL detergent solution (prepared in step I.b. above) in an amount sufficient to produce an aqueous solution absorbance at the $\lambda_{max}$ of 0.4 AU (±0.01 AU) in a cuvette of path length 1.0 cm. Total organic solvent concentration in a wash solution from the concentrated stock solution is less than 0.5%. A 125 mL aliquot of the wash solution is placed into 3 separate disposable 250 mL Erlenmeyer flasks (Thermo Fisher Scientific, Rochester, N.Y.).

d.) Four MFF41 swatches are placed into each flask, flasks are capped and manually shaken to wet the swatches. Flasks are placed onto a Model 75 wrist action shaker from Burrell Scientific, Inc. (Pittsburgh, Pa.) and agitated on the highest setting of 10 (390 oscillations per minute with an arc of 14.6°). After 12 minutes, the wash solution is removed by vacuum aspiration, 125 mL of 0 gpg water is added for a rinse, and the flasks agitated for 4 additional minutes. Rinse solution is removed by vacuum aspiration and swatches are spun in a Mini Countertop Spin Dryer (The Laundry Alternative Inc., Nashua, N.H.) for 5 minutes, after which they are allowed to air dry in the dark.

e.) L*, a*, and b* values for the 3 most consumer relevant fabric types, cotton, nylon and polyester, are measured on the dry swatches using a LabScan XE reflectance spectrophotometer (HunterLabs, Reston, Va.; D65 illumination, 10° observer, UV light excluded). The L*, a*, and b* values of the 12 swatches (3 flasks each containing 4 swatches) are averaged and the hueing deposition (HD) of the dye is calculated for each fabric type using the following equation:

$$HD=DE^*=((L^*_c-L^*_2)^2+(a^*_c-a^*_s)^2+(b^*_c-b^*_s)^2)^{1/2}$$

wherein the subscripts c and s respectively refer to the control, i.e., the fabric washed in detergent with no dye, and the fabric washed in detergent containing dye according to the method described above.

II. Method to Determine if a Dye is a Shading Dye

A dye is considered a shading dye (also known as a hueing dye) for the purposes of the present invention if the $HD_{cotton}$, $HD_{polyester}$ or $HD_{nylon}$ is greater than or equal to 2.0 DE* units according to the formula above. If the value of HD for each fabric type is less than 2.0 DE* units, the dye is not a shading dye for the purposes of the present invention.

Water-Soluble Film

The film of the present invention is soluble or dispersible in water, and preferably has a water-solubility of at least 50%, preferably at least 75% or even at least 95%, as measured by the method set out here after using a glass-filter with a maximum pore size of 20 microns:

50 grams±0.1 gram of pouch material is added in a preweighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred film materials are polymeric materials. The film material can be obtained, for example, by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated water straight from the tap. Preferably such films exhibit good dissolution at temperatures below 25° C., more preferably below 21° C., more preferably below 15° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M9467, M8310, films described in U.S. Pat. No. 6,166,117 and U.S. Pat. No. 6,787,512 and PVA films of corresponding solubility and deformability characteristics. Further preferred films are those describes in US2006/0213801, WO 2010/119022 and U.S. Pat. No. 6,787,512.

Preferred water soluble films are those resins comprising one or more PVA polymers, preferably said water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 cP (cP means Centipoise), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2: 2006 Annex E Brookfield Test method. It is international practice to state the viscosity of 4% aqueous polyvinyl alcohol solutions at 20 .deg.C. All viscosities specified herein in cP should be understood to refer to the viscosity of 4% aqueous polyvinyl alcohol solution at 20 .deg.C, unless specified otherwise. Similarly, when a resin is described as having (or not having) a particular viscosity, unless specified otherwise, it is intended that the specified viscosity is the average viscosity for the resin, which inherently has a corresponding molecular weight distribution. The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt. % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 30 wt. % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt. % of a first PVA polymer that has a viscosity in a range of about 10 to about 15 cP and a degree of hydrolysis in a range of about 84% to about 92%. Another type of embodiment is characterized by the PVA resin including about 45 to about 55 wt. % of the first PVA polymer that has a viscosity in a range of about 10 to about 15 cP and a degree of hydrolysis in a range of about 84% to about 92%. The PVA resin can include about 15 to about 60 wt. % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt. % of the second PVA polymer.

When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

Preferably the PVA resin that has a weighted, average degree of hydrolysis (H .deg.) between about 80 and about 92%, or between about 83 and about 90%, or about 85 and 89%. For example, H .deg. for a PVA resin that comprises two or more PVA polymers is calculated by the formula H.deg.=(Wi−H,) where ½ is the weight percentage of the respective PVA polymer and and H, is the respective degrees of hydrolysis. Still further it is desirable to choose a PVA resin that has a weighted log average viscosity between about 10 and about 25, or between about 12 and 22, or between about 13.5 and about 20. The .micro. for a PVA resin that comprises two or more PVA polymers is calculated−YW−In/by the formula .micro.=e (1 l) where .micro.[ ] is the viscosity for the respective PVA polymers.

Yet further, it is desirable to choose a PVA resin that has a Resin Selection Index (RSI) in a range of 0.255 to 0.315, or 0.260 to 0.310, or 0.265 to 0.305, or 0.270 to 0.300, or 0.275 to 0.295, preferably 0.270 to 0.300. The RSI is calculated by the formula (w[t]\.micro.[{]−Al)/.Sigma. ((W)iMi)>wherein .micro.[(] is seventeen, /, is the average viscosity each of the respective PVA polymers, and Wi is the weight percentage of the respective PVA polymers.

Even more preferred films are water soluble copolymer films comprising a least one anionically modified monomer with formula:

$$[Y]—[G]_n$$

wherein Y represents a vinyl alcohol monomer, G represents a monomer comprising an anionic group and index n is an integer of from 1 to 3. G can be any suitable comonomer capable of carrying of carrying the anionic group, more preferably G is a carboxylic acid. G is preferably selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid and mixtures thereof.

The anionic group of G is preferably selected from the group consisting of $OSO_3M$, $SO_3M$, $CO_2M$, $OCO_2M$, $OPO_3M_2$, $OPO_3HM$ and $OPO_2M$. More preferably anionic group of G is selected from the group consisting of $OSO_3M$, $SO_3M$, $CO_2M$, and $OCO_2M$. Most preferably the anionic group of G is selected from the group consisting of $SO_3M$ and $CO_2M$.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

Unitised Dose Pouch

The pouches described herein may be single or multi-compartment pouch. Where the pouch is a multi-compartment pouch, the compartments preferably have a different aesthetic appearance. A difference in aesthetics can be achieved in any suitable way. One compartment of the pouch may be made using translucent, transparent, semi-transparent, opaque or semi-opaque film, and the second compartment of the pouch may be made using a different film selected from translucent, transparent, semi-transparent, opaque or semi-opaque film such that the appearance of the compartments is different. The compartments of the pouch may be the same size or volume. Alternatively the compartments of the pouch may have different sizes, with different internal volumes. The compartments may also be different from one another in terms of texture or colour. Hence one compartment may be glossy whilst the other is matt. This can be readily achieved as one side of a water-soluble film is often glossy, whilst the other has a matt finish. Alternatively the film used to make a compartment may be treated in a way so as to emboss, engrave or print the film. Embossing may be achieved by adhering material to the film using any suitable means described in the art. Engraving may be achieved by applying pressure into the film using a suitable technique available in the art. Printing may be achieved using any suitable printer and process available in the art. Alternatively, the film itself may be coloured, allowing the manufacturer to select different coloured films for each compartment. Alternatively the films may be transparent or translucent and the composition contained within may be coloured. Thus in a preferred embodiment of the present invention a first compartment has a colour selected from the group consisting of white, green, blue, orange, red, yellow, pink or purple and a second compartment has a different colour selected from the group consisting of white, yellow, orange, blue or green.

The compartments of a multi-compartment pouch can be separate, but are preferably conjoined in any suitable manner. Most preferably the second and optionally third or subsequent compartments are superimposed on the first compartment. In one embodiment, the third compartment may be superimposed on the second compartment, which is in turn superimposed on the first compartment in a sandwich configuration. Alternatively the second and third, and optionally subsequent, compartments may all be superimposed on the first compartment. However it is also equally envisaged that the first, second and optionally third and subsequent compartments may be attached to one another in a side by side relationship. In a preferred embodiment the present pouch comprises three compartments consisting of a large and two smaller compartments. The second and third smaller compartments are superposed on the first larger compartment. The size and geometry of the compartments are chosen such that this arrangement is achievable. The compartments may be packed in a string, each compartment being individually separable by a perforation line. Hence each compartment may be individually torn-off from the remainder of the string by the end-user, for example, so as to pre-treat or post treat a fabric with a composition from a compartment.

The geometry of the compartments may be the same or different. In a preferred embodiment the second and optionally third or subsequent compartment has a different geometry and shape to the first compartment. In this embodiment the second and optionally third compartments are arranged in a design on the first compartment. Said design may be decorative, educative, illustrative for example to illustrate a concept or instruction, or used to indicate origin of the product. In a preferred embodiment the first compartment is the largest compartment having two large faces sealed around the perimeter. The second compartment is smaller covering less than 75%, more preferably less than 50% of the surface area of one face of the first compartment. In the embodiment wherein there is a third compartment, the above structure is the same but the second and third compartments cover less than 60%, more preferably less than 50%, even more preferably less than 45% of the surface area of one face of the first compartment.

Process for Making the Pouch Unitized Dose Product

The pouch of the present invention may be made using any suitable equipment and method. Single compartment pouches are made using vertical, but preferably horizontal form filling techniques commonly known in the art. The film is preferably dampened, more preferably heated to increase the malleability thereof. Even more preferably, the method also involves the use of a vacuum to draw the film into a suitable mould. The vacuum drawing the film into the mould can be applied for 0.2 to 5 seconds, preferably 0.3 to 3 or even more preferably 0.5 to 1.5 seconds, once the film is on the horizontal portion of the surface. This vacuum may preferably be such that it provides an under-pressure of between +10 mbar to +1000 mbar, more preferably from +100 mbar to +600 mbar.

The moulds, in which the pouches are made, can have any shape, length, width and depth, depending on the required dimensions of the pouches. The moulds can also vary in size and shape from one to another, if desirable. For example, it may be preferred that the volume of the final pouches is between 5 and 300 ml, or even 10 and 150 ml or even 20 and 100 ml and that the mould sizes are adjusted accordingly.

Heat can be applied to the film, in the process commonly known as thermoforming, by any means. For example the film may be heated directly by passing it under a heating element or through hot air, prior to feeding it onto the surface or once on the surface. Alternatively it may be heated indirectly, for example by heating the surface or applying a hot item onto the film. Most preferably the film is heated using an infra red light. The film is preferably heated to a temperature of 50 to 120° C., or even 60 to 90° C. Alternatively, the film can be wetted by any mean, for example directly by spraying a wetting agent (including water, solutions of the film material or plasticizers for the film material) onto the film, prior to feeding it onto the surface or once on the surface, or indirectly by wetting the surface or by applying a wet item onto the film.

Once a film has been heated/wetted, it is drawn into an appropriate mould, preferably using a vacuum. The filling of the moulded film can be done by any known method for filling (preferably moving) items. The most preferred method will depend on the product form and speed of filling required. Preferably the moulded film is filled by in-line filling techniques. The filled, open pouches are then closed, using a second film, by any suitable method. Preferably, this is also done while in horizontal position and in continuous, constant motion. Preferably the closing is done by continuously feeding a second film, preferably water-soluble film, over and onto the open pouches and then preferably sealing the first and second film together, typically in the area between the moulds and thus between the pouches.

Preferred methods of sealing include heat sealing, solvent welding, and solvent or wet sealing. It is preferred that only the area which is to form the seal, is treated with heat or solvent. The heat or solvent can be applied by any method, preferably on the closing material, preferably only on the areas which are to form the seal. If solvent or wet sealing or welding is used, it may be preferred that heat is also applied. Preferred wet or solvent sealing/welding methods include applying selectively solvent onto the area between the moulds, or on the closing material, by for example, spraying or printing this onto these areas, and then applying pressure onto these areas, to form the seal. Sealing rolls and belts as described above (optionally also providing heat) can be used, for example.

The formed pouches can then be cut by a cutting device. Cutting can be done using any known method. It may be preferred that the cutting is also done in continuous manner, and preferably with constant speed and preferably while in horizontal position. The cutting device can, for example, be a sharp item or a hot item, whereby in the latter case, the hot item 'burns' through the film/sealing area.

The different compartments of a multi-compartment pouch may be made together in a side-by-side style and consecutive pouches are not cut. Alternatively, the compartments can be made separately. According to this process and preferred arrangement, the pouches are made according to the process comprising the steps of:

a) forming an first compartment (as described above);
b) forming a recess within some or all of the closed compartment formed in step (a), to generate a second moulded compartment superposed above the first compartment;
c) filling and closing the second compartments by means of a third film;
d) sealing said first, second and third films; and
e) cutting the films to produce a multi-compartment pouch.

Said recess formed in step b is preferably achieved by applying a vacuum to the compartment prepared in step a).

Alternatively the second, and optionally third, compartment(s) can be made in a separate step and then combined with the first compartment as described in our co-pending application EP 08101442.5 which is incorporated herein by reference. A particularly preferred process comprises the steps of:

a) forming a first compartment, optionally using heat and/or vacuum, using a first film on a first forming machine;
b) filling said first compartment with a first composition;
c) on a second forming machine, deforming a second film, optionally using heat and vacuum, to make a second and optionally third moulded compartment;
d) filling the second and optionally third compartments;
e) sealing the second and optionally third compartment using a third film;
f) placing the sealed second and optionally third compartments onto the first compartment;
g) sealing the first, second and optionally third compartments; and
h) cutting the films to produce a multi-compartment pouch The first and second forming machines are selected based on their suitability to perform the above process. The first forming machine is preferably a horizontal forming machine.

The second forming machine is preferably a rotary drum forming machine, preferably located above the first forming machine.

It will be understood moreover that by the use of appropriate feed stations, it is possible to manufacture multi-compartment pouches incorporating a number of different or distinctive compositions and/or different or distinctive liquid, gel or paste compositions.

Optional Detergent Composition Components

The composition of the present invention is preferably a liquid. By the term 'liquid' it is meant to include liquid, paste, waxy or gel compositions. The liquid composition may comprise a solid. Solids may include powder or agglomerates, such as micro-capsules, beads, noodles or one or more pearlised balls or mixtures thereof. Such a solid element may provide a technical benefit, through the wash or as a pre-treat, delayed or sequential release component. Alternatively it may provide an aesthetic effect. The compositions of the present invention may comprise one or more of the ingredients discussed below.

Surfactants or Detersive Surfactants

The composition of the present invention preferably comprises further surfactants. The total surfactant level may be in the range of from about 1% to 80% by weight of the composition.

Further detersive surfactants utilized can be of the nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Fabric Care Benefit Agents

The compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition, are suitably at levels of up to about 30% by weight of the composition, more typically from about 1% to about 20%, preferably from about 2% to about 10%.

Detersive Enzymes

Detersive enzymes may be incorporated into the compositions of the present invention. Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

Deposition Aid

Deposition aids may be incorporated into the composition of the present invention. As used herein, "deposition aid" refers to any cationic polymer or combination of cationic polymers that significantly enhance the deposition of a fabric care benefit agent onto the fabric during laundering. Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives and cationic starches.

Rheology Modifier

In a preferred embodiment of the present invention, the composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Builder

The compositions of the present invention may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof (particularly sodium salt Other preferred builders include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), aluminosilicates such as zeolite A, B or MAP; fatty acids or salts, preferably sodium salts, thereof, preferably C12-C18 saturated and/or unsaturated fatty acids; and alkali or alkali earth metal carbonates preferably sodium carbonate.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Other Adjuncts

Examples of other suitable cleaning adjunct materials include, but are not limited to; enzyme stabilizing systems; antioxidants, opacifier, pearlescent agent, hueing dye, scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; perfumes and perfume microcapsules, colored beads, spheres or extrudates; clay softening agents and mixtures thereof.

Composition Preparation

The compositions herein can generally be prepared by mixing the ingredients together. If a pearlescent material is used it should be added in the late stages of mixing. If a rheology modifier is used, it is preferred to first form a premix within which the rheology modifier is dispersed in a portion of the water and optionally other ingredients eventually used to comprise the compositions. This pre-mix is formed in such a way that it forms a structured liquid. To this structured pre-mix can then be added, while the pre-mix is under agitation, the surfactant(s) and essential laundry adjunct materials, along with water and whatever optional detergent composition adjuncts are to be used.

Secondary Packaging

The multi-compartment pouches of the present invention are preferably further packaged in an outer package. Said outer package may be a see-through or partially see-through container, for example a transparent or translucent bag, tub, carton or bottle. The pack can be made of plastic or any other suitable material, provided the material is strong enough to protect the pouches during transport. This kind of pack is also very useful because the user does not need to open the pack to see how many pouches there are left. Alternatively, the pack can have non-see-through outer packaging, perhaps with indicia or artwork representing the visually-distinctive contents of the pack.

Process of Washing

The pouches of the present invention are suitable for laundry cleaning applications. The pouches are suitable for hand or machine washing conditions. When machine washing, the pouch may be delivered from the dispensing drawer or may be added directly into the washing machine drum.

Method for Measuring Weeping

Migration of liquid compounds through the film to the outside of the water soluble package can be quantified using a Corneometer CM825 equipped with CM-825 probe, manufactured by Courage-Khazaka Electronic, Koln, Germany. The equipment is calibrated according to the supplier recommendation. The equipment provides a corneometer value which is recorded. The Corneometer can detect even slightest changes in weeping level since change in the dielectric constant (i.e. presence of fluid on the outside of the pouch) alters the Corneometer value.

The equipment is placed in a conditioned laboratory at 20° C.+/−3 C and 50%+/−10 relative humidity. The pouches are brought to temperature of 20+/−3 C prior to the measurement. The probe is cleaned with a dry and clean paper tissue; then blank measurements are made by slowly wiping the sensor on the clean paper tissue (VWR International bvba, Leuven, Belgium, Cat. No. 115-0600), to ensure there is no contamination on the probe, until the instrument reads a Corneometer value of zero. The probe is placed vertically on the pouch, as per the usage instructions. Ten replicates are measured for each pouch. The center and corners of the top and bottom face of the pouch are tested. Measurement are repeated on 5 different pouches. The data is thus the average of 50 measurements. The probe is cleaned in between each measurement.

The following table provides an interpretation of the corneometer value for weeping.

| Weeping classification | Corneometer value |
|---|---|
| Extremely light | <50 |
| Very light | 50-59 |
| Light | 60-64 |
| Light/Medium | 65-59 |
| Medium | 70-74 |
| Medium/Heavy | 75-79 |
| Heavy | 80-84 |
| Very heavy | 85-89 |
| Extremely heavy | >90 |

The following are examples of the present invention. The following detergent compositions (as set out below, composition A) were prepared comprising differing combinations and levels of solvents.

| Ingredients | A |
|---|---|
| Linear $C_9$-$C_{15}$ Alkylbenzene sulfonic acid | 18.3 |
| $C_{12-14}$ alkyl 9-ethoxylate | 14.7 |
| Citric Acid | 0.7 |
| Fatty acid | 6.0 |
| C12-14 alkyl ethoxy 3 sulfate | 8.7 |
| Chelant | 0.6 |
| Polymer | 5.9 |
| Enzymes | — |
| Structurant | 0.15 |

-continued

| Ingredients | A |
|---|---|
| Solvent system | 37.8 |
| Mono-ethanolamine or NaOH (or mixture thereof) | neutralize to pH to about 7.4 |
| Additives, Minor | To 100% |

All levels are in weight percent of the composition.

Mono compartment pouches are filled with liquid detergents of composition A, wherein the solvent system is selected as below from formulations 1 to 9. The pouches are made using M8779 film, available from Monosol using standard thermoforming techniques. Specifically, 0.7 g of a 76 μm thick film M8779 are thermoformed to a single compartment pouch measuring 41 mm by 43 mm. The pouch is filled with 23.7 mL (25.4 g) of composition A, above.

EXAMPLE 1

The following solvent system formulations 1 to 4 were prepared comprising differing combinations and levels of solvents. The Corneometer value was measured after 4 weeks storage at 32° C. and 80% relative humidity. Based on the value, the weeping profile is classified.

| | DPG level | Water level | Glycerol level | Pdiol level | DEG level | Corneometer value | Weeping classification |
|---|---|---|---|---|---|---|---|
| Formulation 1 (Comparative example) | 0% | 6.1% | 9.0% | 2.7% | 19.9% | 94 | Extremely Heavy |
| Formulation 2 | 2.7% | 6.1% | 9.0% | 0% | 19.9% | 85 | Very Heavy |
| Formulation 3 | 6.9% | 10.9% | 0% | 0% | 19.9% | 81 | Heavy |
| Formulation 4 | 8.1% | 6.1% | 3.6% | 0% | 19.9% | 79 | Medium/Heavy |

DPG (dipropylene glycol) was supplied by Ineos Manufacturing, Koln, Germany. The solvent has an HSP of 28.5 and a clog P of −0.6.

DEG (diethylene glycol) was supplied by Sabic Petrochemicals, Sittard, The Netherlands.

Glycerol was supplied by Brenntag Sa, Orleans, France.

Pdiol (propanediol) was supplied by Ineos Manufacturing, Koln, Germany.

EXAMPLE 2

The following solvent system formulations 2 to 5 were prepared comprising differing combinations and levels of solvents. The Corneometer value was measured after 4 weeks storage at 32° C. and 80% relative humidity. Based on the value, the weeping profile is classified.

| | DPG level | Water level | Glycerol level | Pdiol level | DEG level | Corneometer value | Weeping classification |
|---|---|---|---|---|---|---|---|
| Formulation 2 | 2.7% | 6.1% | 9.0% | 0.0% | 19.9% | 85 | Very Heavy |
| Formulation 3 | 6.9% | 10.9% | 0.0% | 0.0% | 19.9% | 81 | Heavy |
| Formulation 4 | 8.1% | 6.1% | 3.6% | 0.0% | 19.9% | 79 | Medium/Heavy |
| Formulation 5 | 19.9% | 6.1% | 9.0% | 0.0% | 2.7% | 66 | Light/Medium |

EXAMPLE 3

The following solvent system formulations 1, 2, 5 and 7 were prepared comprising differing combinations and levels of solvents. The Corneometer value after 4 weeks storage at 32° C. and 80% relative humidity. Based on the value, the weeping profile is classified.

| | DPG level | Water level | Glycerol level | Pdiol level | DEG level | Corneometer value | Weeping classification |
|---|---|---|---|---|---|---|---|
| Formulation 1 (Comparative example) | 0.0% | 6.1% | 9.0% | 2.7% | 19.9% | 94 | Extremely Heavy |
| Formulation 2 | 2.7% | 6.1% | 9.0% | 0.0% | 19.9% | 85 | Very Heavy |
| Formulation 6 | 15.7% | 6.1% | 9.0% | 7.0% | 0.0% | 79 | Medium/Heavy |
| Formulation 5 | 19.9% | 6.1% | 9.0% | 0.0% | 2.7% | 66 | Light/Medium |

EXAMPLE 4

The following solvent system formulations 1 to 8 were prepared comprising differing combinations and levels of solvents. The Corneometer value was measured after 4 weeks storage at 32° C. and 80% relative humidity. Based on the value, the weeping profile is classified.

| | DPG level | Water level | Glycerol level | Pdiol level | DEG level | Corneometer value | Weeping classification |
|---|---|---|---|---|---|---|---|
| Formulation 1 (Comparative example) | 0.0% | 6.1% | 9.0% | 2.7% | 19.9% | 94 | Extremely Heavy |
| Formulation 2 | 2.7% | 6.1% | 9.0% | 0.0% | 19.9% | 85 | Very Heavy |
| Formulation 4 | 8.1% | 6.1% | 3.6% | 0.0% | 19.9% | 79 | Medium/Heavy |
| Formulation 6 | 15.7% | 6.1% | 9.0% | 7.0% | 0.0% | 79 | Medium/Heavy |
| Formulation 5 | 19.9% | 6.1% | 9.0% | 0.0% | 2.7% | 66 | Light/Medium |
| Formulation 7 | 19.9% | 6.1% | 4.7% | 7.0% | 0.0% | 64 | Light |
| Formulation 3 | 6.9% | 10.9% | 0.0% | 0.0% | 19.9% | 81 | Heavy |
| Formulation 8 | 19.9% | 10.9% | 0.0% | 7.0% | 0.0% | 59 | Very Light |

EXAMPLE 5

The following solvent system formulations 5, 7, 8 and 9 were prepared comprising differing combinations and levels of solvents. The Corneometer value was measured after 4 weeks storage at 32° C. and 80% relative humidity. Based on the value, the weeping profile is classified.

| | DPG level | Water level | Glycerol level | Pdiol level | DEG level | Corneometer value | Weeping classification |
|---|---|---|---|---|---|---|---|
| Formulation 9 | 19.9% | 8.8% | 9.0% | 0.0% | 0.0% | 72 | Medium |
| Formulation 5 | 19.9% | 6.1% | 9.0% | 0.0% | 2.7% | 66 | Light/Medium |
| Formulation 7 | 19.9% | 6.1% | 4.7% | 7.0% | 0.0% | 64 | Light |
| Formulation 8 | 19.9% | 10.9% | 0.0% | 7.0% | 0.0% | 59 | Very Light |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for reducing migration and weeping of a composition through a water soluble film, comprising the steps of a) providing an anionic surfactant;

b) mixing said anionic surfactant with a solvent system comprising at least one primary solvent having Hansen solubility (δ) of less than about 29, thereby forming a composition, wherein the composition further comprises a hueing dye, wherein the hueing dye is selected from the group having Formula I below:

$$[D]—[A]_n \qquad \text{Formula I}$$

wherein D represents the residue of a dye comprising a chromophore and A is a moiety selected from the group consisting of $OSO_3M$, $SO_3M$, $CO_2M$, $OCO_2M$, $OPO_3M_2$, $OPO_3HM$ and $OPO_2M$, M is selected from the group consisting of Hydrogen, an alkali or alkali earth metal ion and the index n is an integer from 1 to 6; and c) encapsulating said composition in a water soluble film, wherein the water soluble film comprises a polymer selected from those having Formula V:

$$[Y]—[G]_n \qquad \text{Formula V}$$

wherein Y represents a vinyl alcohol monomer and G represents a monomer comprising an anionic group selected from the group consisting of $OSO_3M$, $SO_3M$, $CO_2M$, $OCO_2M$, $OPO_3M_2$, $OPO_3HM$ and $OPO_2M$ and the index n is from 1 to 3.

2. A method according to claim 1 wherein the primary solvent has molecular weight of less than about 1500.

3. A method according to claim 1 wherein the primary solvent has a cLog P of greater than about −1.0.

4. A method according to claim 1 wherein the primary solvent has a Hydrogen bonding component of less than about 20.5.

5. A method according to claim 1 wherein G is selected from the group consisting of carboxylic acids.

6. A method according to claim 1 wherein the anionic surfactant is present at a level of from about 2% to about 60.

7. A method according to claim 1 wherein the primary solvent is selected from the group consisting of polyethylene glycol (PEG) polymer having molecular weight between about 400 and about 600, dipropylene glycol (DPG), nbutoxy propoxy propanol (nBPP) and mixtures thereof.

8. A method according to claim 1 wherein the primary solvent is present at a level of from about 1 to about 25%.

9. A method according to claim 1 wherein the solvent system additionally comprises a secondary solvent selected from the group consisting of glycerol, water and mixtures thereof.

10. A method according to claim 9 wherein the secondary solvent is glycerol and is present at a level of less than about 5%.

11. A method according to claim 9 wherein the secondary solvent is water and is present at a level of less than about 20%.

12. A method according to claim 9 wherein the ratio of primary solvent to glycerol is from 7:1 to 1:5.

13. The method according to claim 1 wherein in formula I, A is selected from the group consisting of $OSO_3M$, $SO_3M$, $CO_2M$, and $OCO_2M$.

14. The method according to claim 1 wherein M is selected from the group consisting of hydrogen, sodium or potassium ion.

15. The method according to claim 1 wherein in formula I, the index n is from 1 to 4.

16. The method according to claim 1 wherein the chromophore group of dye residue, D, provides the negatively charged hueing dye with a maximum extinction coefficient in methanol solution greater than about 1000 liter/mol/cm in the wavelength range of about 400 nm to about 750 nm.

17. The method according to claim 1 wherein chromophore group of dye residue, D, is selected from the group consisting of benzodifurane, methine, triphenylmethane, azine, tripehnoxazine, naphthalimide, pyrazole, naphthoquinone, anthraquinone, mono-azo and bis-azo and mixtures thereof.

18. The method according to claim 1, wherein G is selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid and mixtures thereof.

19. The method according to claim 16, wherein the chromophore group of dye residue, D, provides the negatively charged hueing dye with a maximum extinction coefficient of from about 10,000 to about 100,000 liter/mol/cm in the wavelength range of about 540 nm to about 630 nm.

20. The method according to claim 17 wherein chromophore group of the dye residue, D, is selected form the group consisting of Azine, anthraquinone, azo chromophores and mixtures thereof.

* * * * *